US006916027B2

(12) United States Patent
Chen

(10) Patent No.: US 6,916,027 B2
(45) Date of Patent: Jul. 12, 2005

(54) ADJUSTABLE SKATE

(75) Inventor: Henry T. Chen, Taipei (TW)

(73) Assignee: Minson Enterprises, Co. Ltd., Taiwan (CN)

( * ) Notice: Subject to any disclaimer, the term of this patent is extended or adjusted under 35 U.S.C. 154(b) by 58 days.

(21) Appl. No.: 10/325,604

(22) Filed: Dec. 19, 2002

(65) Prior Publication Data

US 2003/0116929 A1 Jun. 26, 2003

Related U.S. Application Data

(63) Continuation-in-part of application No. 10/004,163, filed on Oct. 30, 2001, which is a continuation of application No. 09/833,758, filed on Apr. 12, 2001, now abandoned, which is a continuation of application No. 09/141,170, filed on Aug. 27, 1998, now Pat. No. 6,217,039.

(60) Provisional application No. 60/073,464, filed on Feb. 2, 1998.

(51) Int. Cl.[7] ..... A63C 1/26; A63C 17/26

(52) U.S. Cl. ..... 280/11.26

(58) Field of Search ..... 280/11.19, 11.231, 280/11.26, 11.27, 11.12; 36/97

(56) References Cited

U.S. PATENT DOCUMENTS

| | | | | | |
|---|---|---|---|---|---|
| 831,210 | A | | 9/1906 | Bosley | 36/8 |
| 2,009,684 | A | | 7/1935 | Affronte | 36/2.5 |
| 2,112,052 | A | | 3/1938 | Smith | 36/2.5 |
| 2,391,720 | A | | 12/1945 | Ludwig | 36/11.5 |
| 2,497,175 | A | | 2/1950 | Mantos | 36/2.5 |
| 2,523,449 | A | | 9/1950 | Rosenweig | 36/2.5 |
| 2,572,050 | A | | 10/1951 | Ornstein | 280/11.3 |
| 2,603,889 | A | | 7/1952 | Lahnstein et al. | 36/2.5 |
| 2,732,217 | A | * | 1/1956 | Dore | 280/11.26 |
| 2,734,284 | A | | 2/1956 | Seurbom | 36/2.5 |
| 2,746,117 | A | | 5/1956 | Maccarone | 36/46.5 |
| 3,007,706 | A | * | 11/1961 | Pullen | 280/11.26 |
| 3,027,658 | A | | 4/1962 | Rigsby | 36/2.5 |
| 2,745,196 | A | | 5/1956 | Schneider et al. | 36/2.5 |
| 3,045,367 | A | | 7/1962 | McKeon | 25/72 |
| 3,058,241 | A | | 10/1962 | Rigsby | 36/2.5 |
| 3,309,098 | A | * | 3/1967 | Parker | 280/11.26 |
| 3,389,481 | A | | 6/1968 | England | 36/2.5 |
| 3,744,163 | A | | 7/1973 | Simister | 36/2.5 |
| 3,993,318 | A | | 11/1976 | Rothmayer | 280/11.26 |
| 3,997,985 | A | | 12/1976 | Shiina | 36/97 |
| 4,060,918 | A | | 12/1977 | Mandel | 36/97 |
| 4,083,128 | A | | 4/1978 | Rossman | 36/97 |
| 4,126,323 | A | | 11/1978 | Scherz | 280/11.12 |
| 4,304,417 | A | | 12/1981 | Hsieh | 280/11.26 |
| 4,328,627 | A | | 5/1982 | Sanders | 36/115 |
| 4,418,929 | A | | 12/1983 | Gray | 280/11.23 |

(Continued)

FOREIGN PATENT DOCUMENTS

| | | | | |
|---|---|---|---|---|
| AU | 268424 | * | 7/1965 | 280/11.26 |
| CA | 714751 | | 8/1965 | |
| CA | 1321066 | | 8/1993 | |
| FR | 2584936 | | 1/1987 | 280/11.26 |
| FR | 2 668 072 | | 10/1990 | |
| FR | 2658371 | | 8/1991 | 280/11.26 |
| FR | 2672812 | | 8/1992 | 280/11.26 |

*Primary Examiner*—Frank Vanaman
(74) *Attorney, Agent, or Firm*—Westman, Champlin & Kelly P.A.

(57) ABSTRACT

A skate comprises a chassis with a variable length boot disposed thereon. The variable length boot includes a toe portion fixedly disposed upon the chassis and a heel portion slidably disposed upon the chassis. The heel portion is slidable in relation to the toe portion along the longitudinal axis of the skate to increase or decrease the size of the boot. A locking mechanism attached to the heel portion locks the heel portion to the chassis at a selected position. The selected position is chosen from a plurality of spaced-apart slots disposed within the chassis. The locking mechanism includes a positionable clasp insertable into a selected slot to lock the heel portion to the chassis at the selected position.

26 Claims, 5 Drawing Sheets

U.S. PATENT DOCUMENTS 4,468,045 A 8/1984 Sarazen ..... 280/11.3
4,554,749 A 11/1985 Ostrander ..... 36/102
RE32,346 E 2/1987 Klamer et al. ..... 280/11.2
4,684,140 A * 8/1987 Olivieri ..... 280/11.26
4,708,352 A * 11/1987 Vullierme ..... 280/11.26
4,807,893 A 2/1989 Huang ..... 280/11.2
4,839,972 A 6/1989 Pack et al. ..... 36/117
4,944,099 A 7/1990 Davis ..... 36/97
4,998,358 A 3/1991 Girardelli ..... 36/117
D323,055 S 1/1992 Cavasin ..... D2/275
D323,056 S 1/1992 Cavasin ..... D2/275
D324,937 S 3/1992 Cavasin ..... D2/276
5,172,924 A 12/1992 Barci ..... 280/14.2
5,184,834 A 2/1993 Yu ..... 280/7.13
5,388,846 A 2/1995 Gierveld ..... 280/11.22
5,400,484 A 3/1995 Gay ..... 24/585
5,408,763 A 4/1995 Sartor et al. ..... 36/115
5,416,988 A 5/1995 Potter et al. ..... 36/89
5,452,907 A 9/1995 Meibock et al. ..... 280/11.22
5,459,949 A 10/1995 MacPhail ..... 36/117
5,475,936 A 12/1995 Cavasin ..... 36/115
5,484,149 A 1/1996 Lee ..... 280/11.26
5,498,009 A 3/1996 Young ..... 280/11.26
5,615,901 A 4/1997 Piotrowski ..... 280/7.14
5,645,288 A 7/1997 Lu ..... 280/11.26
5,678,833 A 10/1997 Olson et al. ..... 280/11.22
5,682,687 A 11/1997 Arai ..... 36/97
5,735,536 A 4/1998 Myers et al. ..... 280/7.13
5,741,018 A 4/1998 Huang ..... 280/11.3
5,762,346 A 6/1998 Conte ..... 280/11.22
5,765,870 A 6/1998 Riley ..... 280/825
5,775,705 A 7/1998 Cochimin ..... 280/7.1
5,794,362 A 8/1998 Polk, III et al. ..... 36/97
5,803,467 A 9/1998 Piotrowski ..... 280/7.14
5,836,592 A 11/1998 Chang ..... 280/11.26
5,842,293 A 12/1998 Young ..... 36/97
5,899,006 A 5/1999 Donnadieu ..... 36/97
5,913,526 A 6/1999 Olson et al. ..... 280/11.22
5,924,218 A 7/1999 Dalvy et al. ..... 36/55
5,934,693 A 8/1999 Nicoletti ..... 280/11.22
5,951,028 A 9/1999 Lovitt et al. ..... 280/11.22
5,971,406 A 10/1999 Lyman ..... 280/11.22
5,992,861 A 11/1999 Piotrowski ..... 280/7.14
5,993,585 A 11/1999 Goodwin et al. ..... 156/145
6,045,144 A 4/2000 Wong ..... 280/11.26
6,050,004 A 4/2000 Miralles et al. ..... 36/97
6,050,574 A 4/2000 Olson et al. ..... 280/11.22
6,070,885 A 6/2000 Ferone ..... 280/11.19
6,073,941 A 6/2000 Hilgarth ..... 280/11.22
6,082,027 A 7/2000 Wagonhurst ..... 36/97
6,113,111 A 9/2000 Gierveld et al. ..... 280/11.15
6,173,975 B1 1/2001 Brandner ..... 280/11.22
6,193,277 B1 2/2001 Marasco et al. ..... 280/825
6,212,796 B1 4/2001 Kubelka ..... 36/50.1
6,213,479 B1 4/2001 Cochimin ..... 280/7.1
6,216,366 B1 4/2001 Donnadieu ..... 36/97
6,217,039 B1 4/2001 Iverson et al. ..... 280/11.26
6,241,264 B1 6/2001 Page ..... 280/11.19
6,247,707 B1 6/2001 Conte ..... 280/11.221
6,273,437 B1 8/2001 Lovitt et al. ..... 280/11.233
6,276,697 B1 8/2001 Lin ..... 280/11.26
6,308,965 B1 10/2001 Yang ..... 280/11.221
6,374,516 B1 4/2002 Bonaventure et al. ..... 36/115
6,402,163 B1 6/2002 Pratt ..... 280/11.26
6,422,578 B1 7/2002 Oh ..... 280/11.232
6,422,579 B1 7/2002 Lindblad ..... 280/11.26
6,425,587 B1 7/2002 Moon ..... 280/11.206
6,431,604 B1 8/2002 Goeckel ..... 280/811
6,547,261 B2 * 4/2003 Gorza et al. ..... 280/11.223
6,574,888 B2 * 6/2003 Miller et al. ..... 36/97

* cited by examiner

ADJUSTABLE SKATE

CROSS-REFERENCE TO RELATED APPLICATION(S)

This is a continuation-in-part of U.S. application Ser. No. 10/004,163, filed Oct. 30, 2001; which is a continuation of U.S. application Ser. No. 09/833,758, filed Apr. 12, 2001 now abandoned; which is a continuation of U.S. Ser. No. 09/141,178, filed on Aug. 27, 1998 now U.S. Pat. No. 6,217,039, issue Apr. 17, 2001; which claims priority of U.S. provisional application Ser. No. 60/073,464, filed Feb. 2, 1998.

BACKGROUND OF THE INVENTION

The present invention relates to skates, and in particular to skates wherein the boot size is adjustable to accommodate different foot sizes.

Both ice skating and in-line skating have been a popular recreational activities for many years, especially for children. However, children have growing feet, and to enjoy skating the skates should properly fit the child's feet. Of course with growing feet, a new pair of skates must be purchased as the child's feet grow, sometimes on an annual basis. Additionally, many elementary schools have begun incorporating in-line skating into daily physical exercise activities. In order to accommodate the various foot sizes of many children, many different sized skates must be purchased. Assigning a child the correct skate size is time intensive, as is the process of collecting and distributing the skate during the exercise periods.

There exists in the prior art boots that are modifiable in length. However, there does not exist in the prior art skates that can be modified in length, and yet be durable, and also have a minimum number of parts to keep down costs and be easy for children to use. Thus, there is a need to provide a skate that can be modified in length, durable to the rigors that children put skates through and also be simple for children to use. The skate of the present invention, being modifiable in length and width, durable and simple to use is advantageous especially for use by youth whose foot size may change significantly in a short period of time. Additionally, the skate of the present invention is advantageous for schools where a number of children, having many different foot sizes, need proper fitting skates and a relatively short amount of time to collect or distribute the skates.

BRIEF SUMMARY OF THE INVENTION

The present invention comprises a skate that has a variable length boot disposed upon a frame. The boot includes a toe support. The toe support is disposed upon a forward section of the frame. The heel portion is slidably disposed upon a rear section of the frame and is slidable in relation to the toe support to modify the length of the boot. The rearward section of the frame includes a plurality of spaced-apart slots for receiving a clasp of a locking mechanism. The locking mechanism locks the heel portion to the rearward section of the frame at a selected position, defining the length of the boot. The locking mechanism includes a lever connected to the clasp to urge the clasp into engagement with a selected slot.

DETAILED DESCRIPTION

Figure 1:
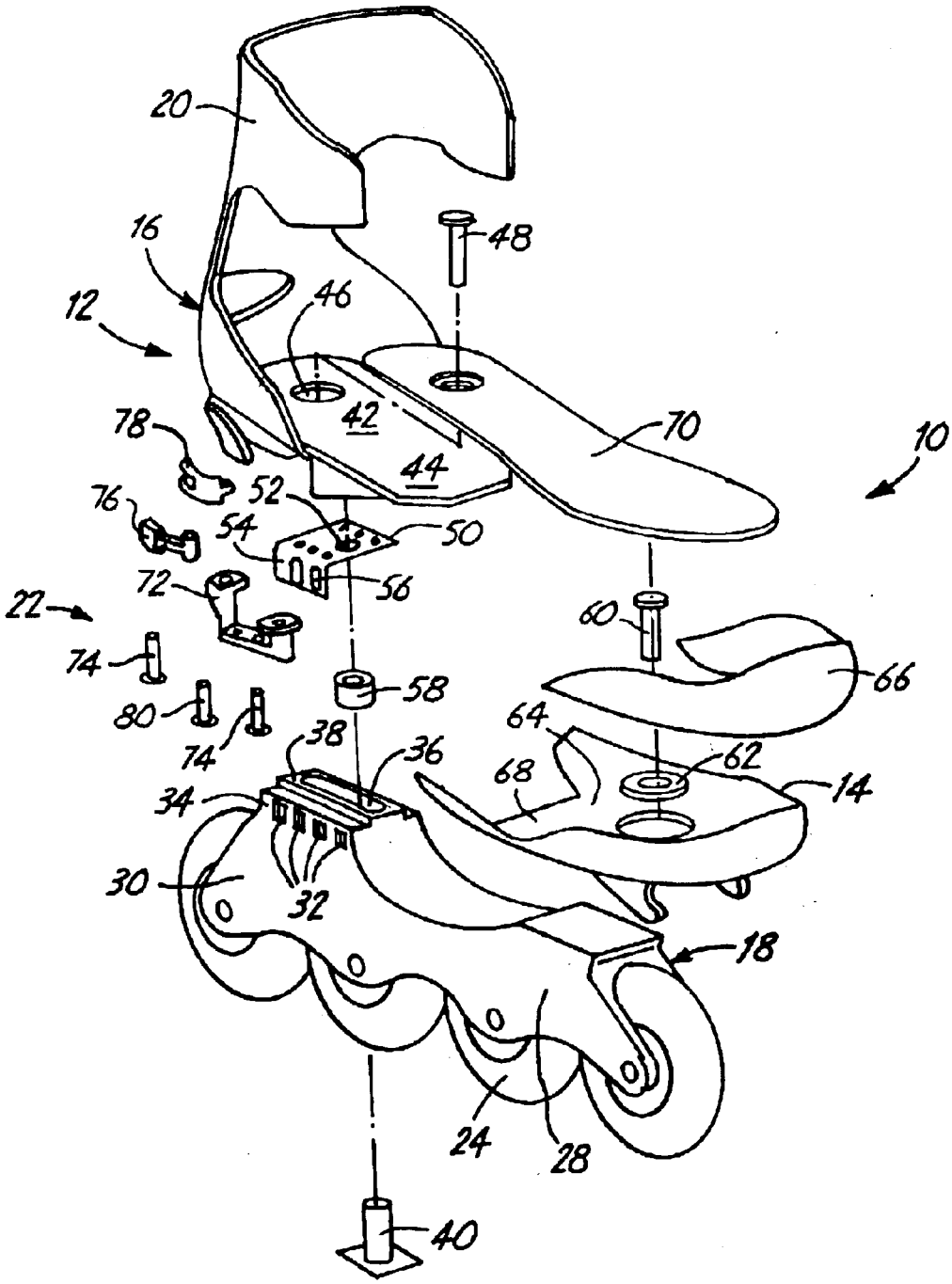
FIG. 1 is an exploded perspective view of a first embodiment of an adjustable skate of the present.

The skate of the present invention is generally illustrated at 10 in FIG. 1. The skate 10 includes a boot 12 whose size may be modified in length. The boot 12 includes a toe support 14 and a heel portion 16 disposed upon a chassis 18. The boot 12 further includes an integrally formed cuff 20. A conventional buckle or a suitable fastener (not shown) is secured to the cuff 20 so that the cuff 20 may be securely fastened to the leg of a wearer. The heel portion 16 is slidably attached to the chassis 18 and is positionable along a longitudinal axis of the skate 10 to increase or decrease the length of the boot 12. Upon selectively positioning the heel portion 16 to achieve the desired length of the boot 12, the heel portion 16 is locked at the selected position to the chassis 18 by a locking mechanism 22.

Figure 3:
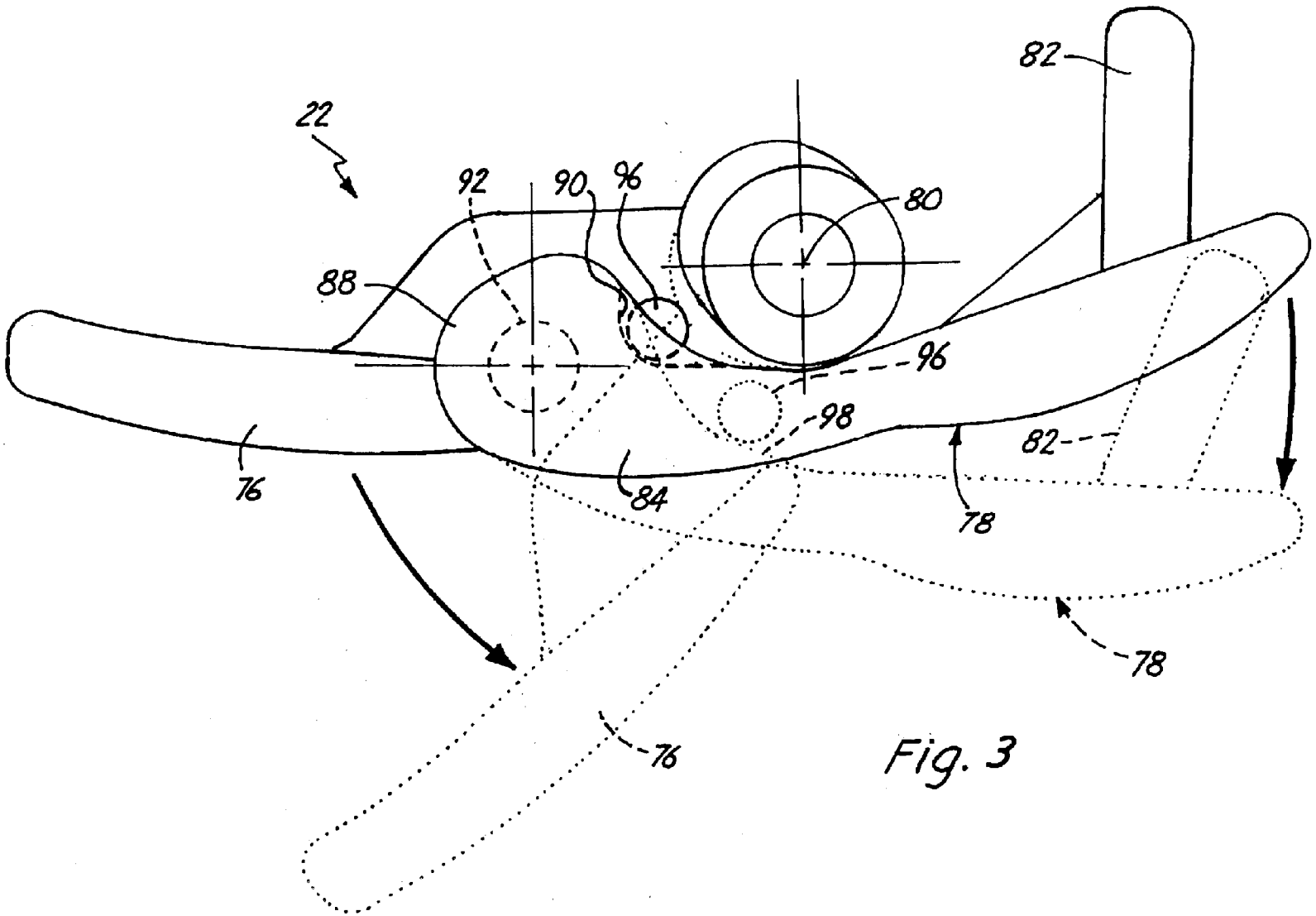
FIG. 3 is a top plan view of the locking mechanism of the present invention.
Figure 4:
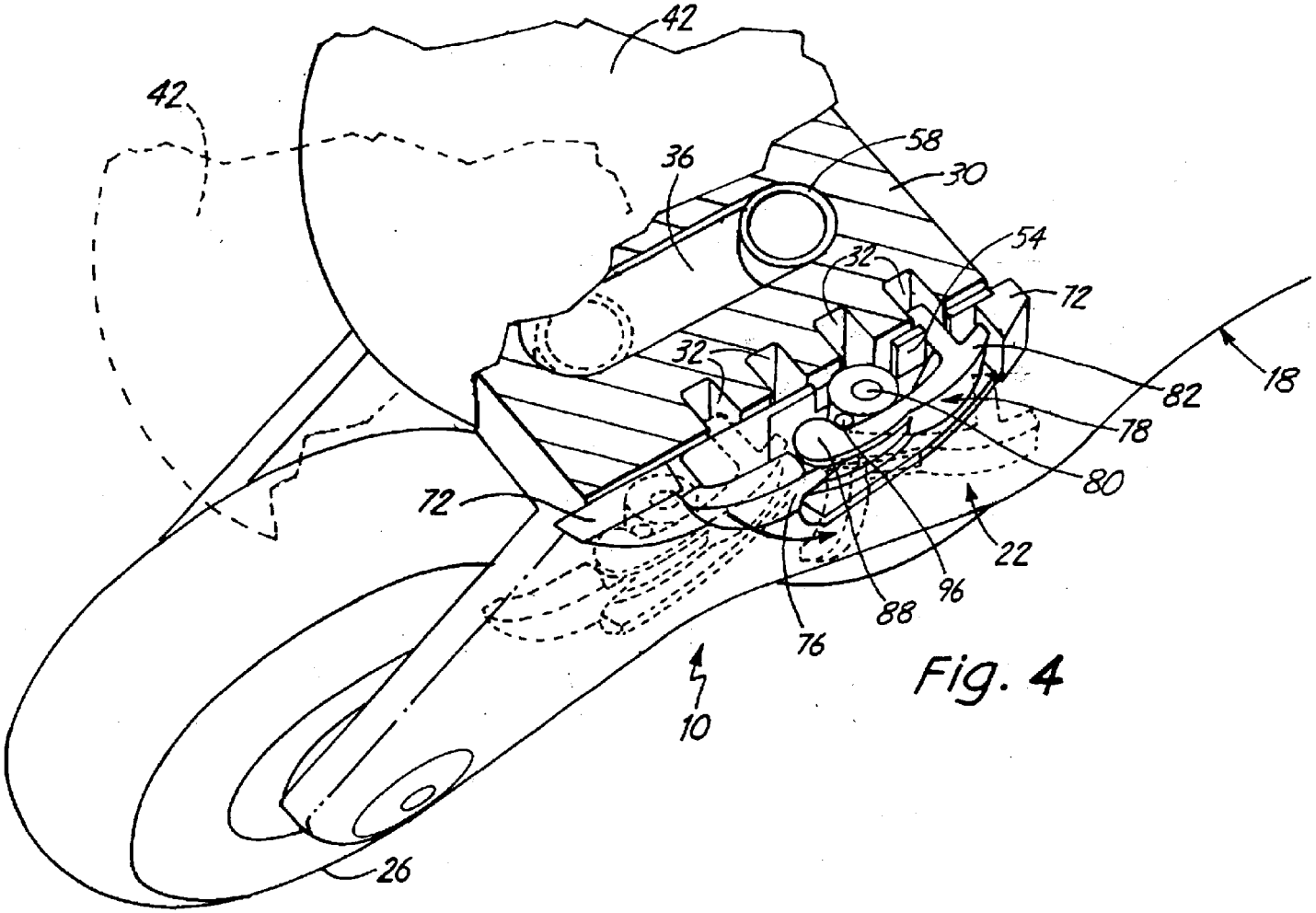
FIG. 4 is a partial perspective view of a locking mechanism engaging and disengaging a forward section the skate of the present invention.
Figure 5:
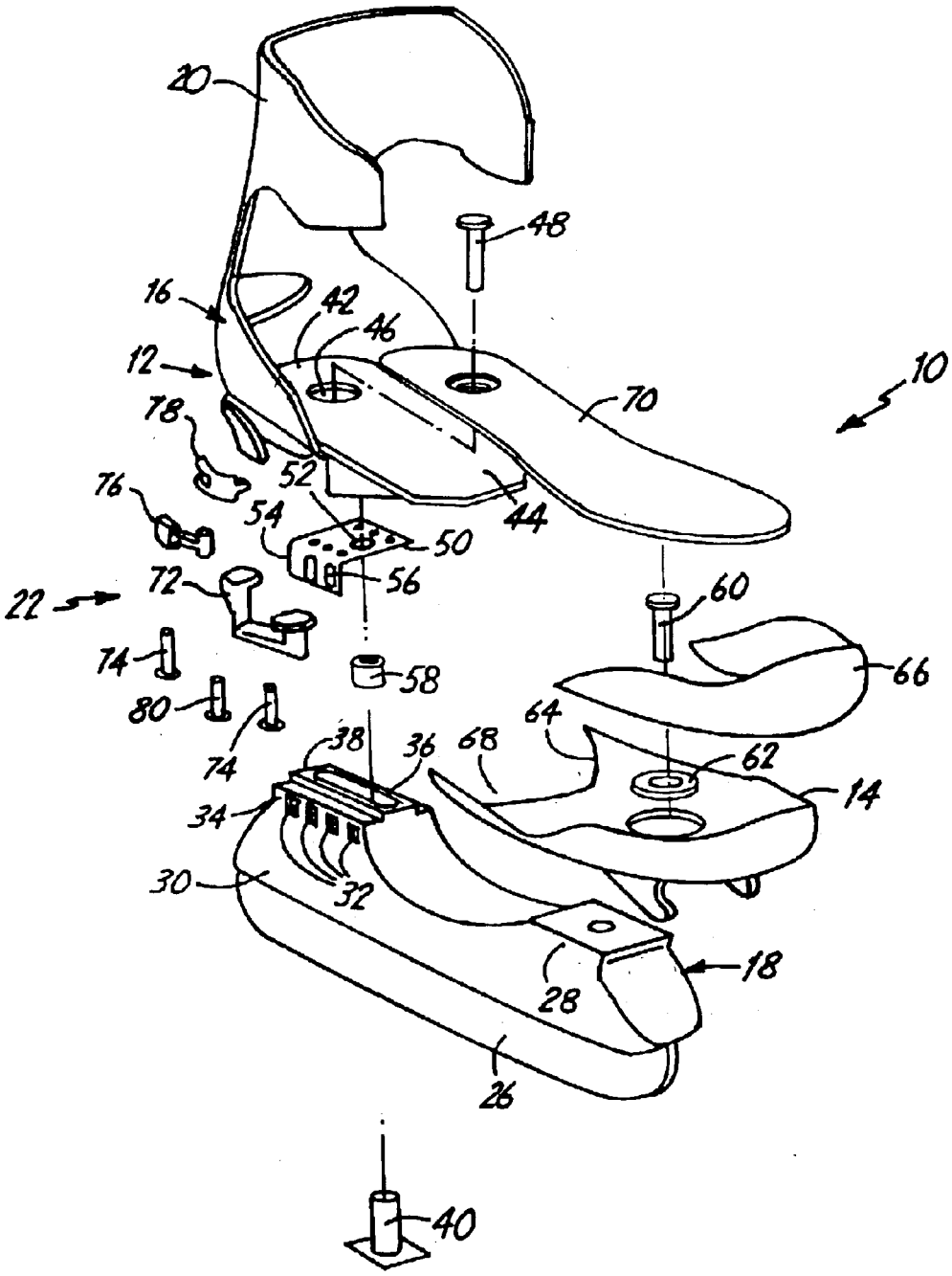
FIG. 5 is a perspective view of a second embodiment of the present invention.

In a first embodiment of the present invention as illustrated in FIGS. 1–4, the chassis 18 retains a plurality of freewheeling wheels 26 as is commonly known in the art of inline skates. The wheels 24 are rotatably secured to the chassis 18 by suitable fasteners that are well known in the art. In a second embodiment of the present invention as illustrated in FIG. 5, the chassis 18 retains an ice engaging blade 26 as is commonly known in the art of ice skates. A suitable liner (not shown) is provided to fit within the boot 12 and accept a foot of the wearer. The liner has an elastic section proximate the toe box so that the liner can accommodate different foot sizes. Such liners are known in the art. In either embodiment, the frame 18 further comprises a forward stanchion 28 and a rearward stanchion 30. For descriptive purposes, the term forward corresponds to the area of the skate 10 for receiving and supporting a ball and toe area of the foot, while the term rearward corresponds to the area of the skate 10 for receiving and supporting a heel area of the foot.

As illustrated in FIG. 1, the rearward stanchion 30 is preferably formed to include a plurality of spaced-apart slots 32 disposed within a side surface 34. Each slot 32 is spaced apart a selected distance and works in conjunction with the locking mechanism 22 to lock the heel portion 16 to the rearward stanchion 30 at the selected position. The selected position corresponds to the overall length of the boot 12, thus the position of each spaced-apart slot 32 corresponds to a different selected length of the boot. The rearward stanchion 28 further includes an elongated slot 36 disposed within a top surface 38. A cavity (not shown) positioned under the top surface 38 and within the rearward stanchion 30 houses a locking nut 40. The locking nut 40 includes a square head and seats within the rearward stanchion. The elongated slot 36 partially receives the nut 40 while inner sidewalls of the rearward stanchion 30 engage the nut 40. Thus, the nut 40 is prevented from rotating within the rearward stanchion 30, but allowed to slide within the elongated slot 36.

The heel portion 16 includes a heel surface 42 with the cuff 20 extending upwardly therefrom. The heel surface 42 extends forwardly and includes a tongue member 42 to engage the toe support 14. An aperture 46 positioned within the heel surface 44 accepts a locking screw 48 to secure the heel portion 16 to the rearward stanchion 30. Positioned between the heel portion 16 and the rearward stanchion 30 is a sliding plate 50. The sliding plate 50 includes a circular aperture 52 and a flange 54 extending downwardly proximate the side surface 34 of the rearward stanchion 30 to guide movement of the heel portion 16 along the rearward stanchion 30. The flange 54 also provides reinforcement to the spaced-apart slots 32 and includes an aperture 56 for cooperating with the locking mechanism 22 and the spaced-apart slots 32. The locking screw 48 inserts through the heel portion 16, the aperture 52, the elongated slot 36 and a spacer 58. The spacer 58 slidably nests within the elongated slot 36. The locking screw 48 threadably engages the locking nut 40 positioned within the rearward stanchion 30 and slidably secures the heel portion 16 to the rearward stanchion 30.

The toe support 14 attaches to the forward stanchion 28 and engages the heel portion 16. A fastener 60 and a spacer 62 fixedly secure the toe support 14 to the forward stanchion 28. The toe support 14 includes a forward toe sole portion 64 and an attached toe cap 66. The toe cap 66 attaches to the toe support 14 proximate the forward toe sole portion 64. Alternatively, the toe support 14 and toe cap 66 are integrally formed with the toe sole portion 64. The toe support 14 further includes a recessed surface 68 for receiving the tongue member 44 of the heel portion 16. It should be appreciated that the tongue member 44 and the toe sole portion 64 cooperate to form a single sole of the boot 12. An insole 70 is included to overlay the heel surface 42, tongue member 44 and toe sole portion 64.

Figure 2:
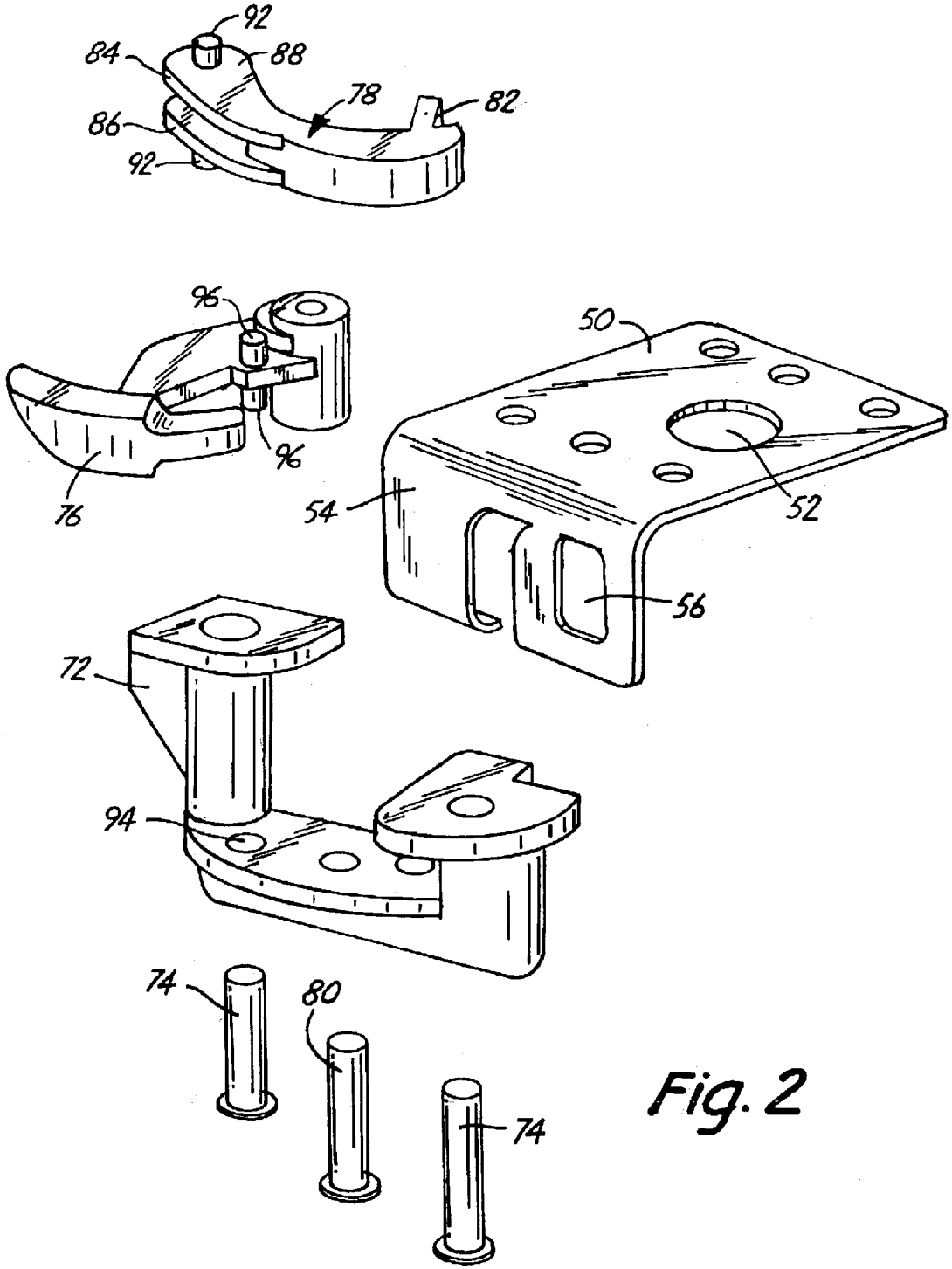
FIG. 2 is an exploded view of a locking mechanism of the present invention.

The heel portion 16 is locked into a selected position by the locking mechanism 22. The locking mechanism 22 includes a bracket 72 attached to the underside surface of the heel portion 16 by rivets 74. As illustrated in FIG. 2, the bracket 72 supports a lever 76 and a locking member 78. Both the lever 76 and the locking member 78 are pivotally attached to the bracket 72 and the heel portion 16. A pin 80 inserts through the bracket 72, lever 76 and heel portion 16 to pivotally attach the lever 76. The locking member 78 includes a clasp 82 having first and second spaced-apart arms, 84 and 86 respectively, extending therefrom. Terminal ends of each arm 84 and 86 include a rounded portion 88 having a camming surface 90. Terminal ends of each arm 84 and 86 further include a cylindrical member 92 disposed on the rounded portion 88. The cylindrical member 92 of the first arm 84 engages an aperture (not shown) disposed within the heel portion 16, while the cylindrical member 92 of the second arm 86 engages an aperture 94 disposed within the bracket 72, thus pivotally attaching the locking member 78 to the bracket 72 and the heel portion 16. The lever 76 slidably disposes between each arm 84 and 86 and further includes posts 96 for engaging the arms 84 and 86 to lock and unlock the locking mechanism.

As illustrated in FIG. 3, the lever 76 is positionable between a first locked position and a second unlocked position (illustrated by dashed lines). Correspondingly, the locking member 78 is positionable between a first engaged position and a second disengaged position (illustrated by dashed lines). Positioning the lever 76 towards the locked position causes each post 96 to engage the adjacent cammed surface 90 of the rounded portion 88 of the respective arm 84 and 86, urging the clasp 82 toward the engaged position wherein the clasp 82 inserts within and engages the selected slot 32, as illustrated in FIG. 4. Upon the clasp 82 engaging the selected slot 32, the heel portion 16 is locked into position and travel upon the rearward stanchion 30 is not permitted. The lever 76 tends to remain in the first locked position due to the frictional engagement of each post 96 with the respective adjacent cammed surface 90. Positioning the lever 76 toward the unlocked position and overcoming the frictional engagement of each post 96 with the respective cammed surface 90 causes each post 96 to disengage from the respective cammed surface 90 and engage an interior surface 98 of the adjacent arm 84 and 86. Further positioning of the lever 76 toward the second unlocked position urges the clasp 82 away from the selected slot 32 and disengaging the clasp 82 therefrom. Upon disengagement, the heel portion 16 is permitted to travel upon the rearward stanchion 30 to increase or decrease the length of the boot 12.

The length of the boot 12 of the present invention is modified by moving the heel portion 16 in relation to the toe support 14. To determine the selected size for the boot 12, the locking mechanism 22 is disengaged, allowing the heel portion 16 to travel upon the rearward stanchion 30. A wearer inserts the proper foot, and the heel portion 16 is positioned to accommodate the size of the foot. To decrease the boot size or to make the boot 12 smaller, the heel portion 16 is moved forwardly until the boot 12 properly conforms to the foot of the wearer. Forward travel of the heel portion 16 is limited by the length of the elongated slot 36 disposed within the rearward stanchion 30 which the locking screw 48 engages at the most forward extent.

To increase the length of the boot 12, the heel portion 16 is moved rearwardly. Rearward travel of the heel portion 16 is once again limited by the length of the elongated slot 36 which the locking screw 48 engages at the most rearward extent. Upon positioning the heel portion 16 to the selected length of the boot 12, the lever 76 is positioned toward the locking position, which urges the clasp 82 into engagement with the most proximate slot 32, and the heel portion 16 is locked into position. As the foot of the wearer grows, or for use by a different wearer, the heel portion 16 may be unlocked, repositioned to fit the new size of the foot and locked into the new position.

Although the present invention has been described with reference to preferred embodiments, workers skilled in the art will recognize that changes may be made in form and detail without departing from the spirit and scope of the invention.

What is claimed is:

1. A skate comprising:

a chassis having a ground engaging mechanism attached thereto;

a variable length boot supported by the chassis, the boot including a heel portion slidably secured to the chassis and a toe support fixedly attached to the chassis, wherein positioning the heel portion along a longitudinal axis of the skate relative to the toe support increases or decreases the length of the boot;

a latching mechanism to lock the heel portion to the chassis at a selected position, the selected position defining the length of the boot, wherein the latching mechanism comprises:

a lever pivotally connected to the heel portion for engaging the chassis, the lever positionable between a locked position and an unlocked position;

a clasp connected to the lever to lock the heel portion at the selected position, the clasp pivotally connected to an exterior surface of the heel portion and positionable between an engaged position and a disengaged position; and wherein the latching mechanism further comprises first and second arms extending from the clasp, each arm including a cammed surface and first and second posts disposed upon the lever, wherein the first post is engageable with the cammed surface of the first arm and the second post is engageable with the cammed surface of the second arm, wherein each post urges the clasp towards the engaged position upon positioning the lever towards the locked position.

2. The skate of claim 1 wherein the latching mechanism further comprises a bracket attached to the heel portion proximate the chassis, wherein the lever and the clasp are pivotally attached to the bracket.

3. The skate of claim 1 wherein the cammed surface of the first and second arms is a cylindrical member.

4. The skate of claim 1, and further comprising a plurality of spaced-apart slots for receiving the clasp, each slot selectively positioned to define the length of the boot when the latching mechanism locks the heel portion to the chassis.

5. The skate of claim 4, wherein the plurality of slots are disposed within the chassis.

6. The skate of claim 1 and further comprising:

an elongated slot disposed within the chassis; and a fastener attached to the heel portion for slidably securing the heel portion to the chassis, the fastener insertable through the elongated slot, wherein the fastener permits the heel portion to only be positionable along a longitudinal axis of the skate.

7. The skate of claim 6, and further comprising a sliding plate attached to the heel portion, the sliding plate including a sidewall extending away from the heel portion and engaging a side surface of the chassis to prohibit transversal movement of the heel portion.

8. The skate of claim 1 wherein the ground engaging mechanism is an ice blade or a plurality of wheels.

9. A skate comprising:

a chassis for holding a ground engaging mechanism attached thereto, the chassis having a rearward section and a forward section;

a plurality of spaced-apart slots disposed upon the rearward section of the chassis;

a boot having a heel portion and a toe portion, wherein the heel portion is slidably disposed upon the rearward section of the chassis to adjust the length of the boot and the toe portion is fixedly disposed upon the forward section of the chassis; and a latching mechanism attached to the heel portion for securing the heel portion to the rearward section of the chassis in a selected position, the latching mechanism comprising a latching member to engage one of the spaced-apart slots and a lever connected to the latching member, the lever providing a mechanism to engage and disengage the latching member, the latching member comprising a clasp and first and second spaced-apart arms extending from the clasp, wherein the lever is disposed between and engages the first and second arms, and wherein at least one arm is pivotally connected to the heel portion.

10. The skate of claim 9 wherein the latching mechanism further comprises a bracket attached to the heel portion, wherein the lever and the latching member are pivotally attached to the bracket.

11. The skate of claim 9 wherein the first arm and the second arm extending from the clasp each include a cammed surface, and the latching mechanism further comprises first and second posts disposed upon the lever, wherein the first post is engageable with the cammed surface of the first arm and the second post is engageable with the cammed surface of the second arm, wherein each post urges the clasp towards the engaged position upon positioning the lever towards the locked position.

12. The skate of claim 9 and further comprising:

a plate attached to the heel portion, the plate including an aperture;

an elongated slot disposed within the rearward section of the chassis, the elongated slot positioned along the longitudinal axis of the skate; and a fastener connected to the heel portion and insertable through the aperture and the elongated slot, the fastener securing the heel portion to the rearward section of the chassis, wherein the heel portion is positionable along the rearward section of the chassis.

13. The skate of claim 12, wherein the plate includes a downwardly extending sidewall to guide the heel portion along the rearward section of the chassis.

14. The skate of claim 9 wherein the ground engaging mechanism is an ice blade or a plurality of wheels.

15. A skate comprising:

a frame for holding a ground engaging mechanism attached thereto, the frame having a rearward section and a forward section;

a variable length boot, the boot having a heel portion slidably secured to the rearward section and a toe portion attached to the forward section;

a clasping mechanism connected to the heel portion;

a plurality of spaced-apart slots disposed upon the rearward section of the chassis for receiving the clasping mechanism an elongated slot disposed within the chassis along a longitudinal axis of the skate; and a fastener disposed within the elongated slot and connected to the rearward section of the frame, the fastener slidably securing the heel portion to the rearward section the clasping mechanism comprising:

a bracket attached to the heel portion proximate to the plurality of spaced-apart slots;

a clasp pivotally connected to the bracket for engaging a selected slot;

a lever connected to the clasp, the lever providing a mechanism to engage the clasp with the selected slot; and wherein the clasp comprises first and second spaced-apart arms and at least one arm being pivotally secured either to the bracket or to the heel portion, and the lever being disposed between and engaging each arm, such that positioning the lever urges the arms to pivot and position the clasp to engage or disengage the selected slot.

16. The skate of claim 15 wherein the first arm and the second arm each include a cammed surface, and the latching mechanism further comprises first and second posts disposed upon the lever, wherein the first post is engageable with the cammed surface of the first arm and the second post is engageable with the cammed surface of the second arm, wherein each post urges the clasp towards the engaged position upon positioning the lever towards the locked position.

17. The skate of claim 15 wherein the ground engaging mechanism is an ice blade or a plurality of wheels.

18. A skate comprising:

a frame for holding a ground engaging mechanism attached thereto, the frame having a rearward section and a forward section;

a variable length boot, the boot having a heel portion slidably secured to the rearward section and a toe portion attached to the forward section;

a clasping mechanism connected to the heel portion;

a plurality of spaced-apart slots disposed upon the rearward section of the chassis for receiving the clasping mechanism;

an elongated slot disposed within the chassis along a longitudinal axis of the skate; and a fastener disposed within the elongated slot and connected to the rearward section of the frame, the fastener slidably securing the heel portion to the rearward section.

19. The skate of claim 18 wherein the ground engaging mechanism is an ice blade or a plurality of wheels.

20. A skate comprising:

a chassis having a ground engaging mechanism attached thereto;

a variable length boot supported by the chassis, the boot including a heel portion slidably secured to the chassis and a toe support fixedly attached to the chassis, wherein positioning the heel portion along a longitudinal axis of the skate relative to the toe support increases or decreases the length of the boot;

a latching mechanism to lock the heel portion to the chassis at a selected position, the selected position defining the length of the boot, wherein the latching mechanism comprises:

a lever pivotally connected to the heel portion for engaging the chassis, the lever positionable between a locked position and an unlocked position;

a clasp connected to the lever to lock the heel portion at the selected position, the clasp pivotally connected to an exterior surface of the heel portion and positionable between an engaged position and a disengaged position and a plurality of spaced-apart slots for receiving the clasp, each slot selectively positioned to define the length of the boot when the latching mechanism locks the heel portion to the chassis;

an elongated slot disposed within thechassis; and a fastener attached to the heel portion for slidably securing the heel portion to the chassis, the fastener insertable through the elongated slot, wherein the fastener permits the heel portion to only be positionable along a longitudinal axis of the skate.

21. The skate of claim 20, and further comprising a sliding plate attached to the heel portion, the sliding plate including a sidewall extending away from the heel portion and engaging a side surface of the chassis to prohibit transversal movement of the heel portion.

22. The skate of claim 20 wherein the latching mechanism further comprises a bracket attached to the heel portion proximate the chassis, wherein the lever and the clasp are pivotally attached to the bracket.

23. The skate of claim 20 wherein the latching mechanism further comprises first and second arms extending from the clasp, each arm including a cylindrical member, wherein the cylindrical member of the first arm pivotally engages the heel portion and the cylindrical member of the second arm pivotally engages the bracket.

24. The skate of claim 20 wherein the latching mechanism further comprises:

first and second arms extending from the clasp, each arm including a cammed surface; and first and second posts disposed upon the lever, wherein the first post is engageable with the cammed surface of the first arm and the second post is engageable with the cammed surface of the second arm, wherein each post urges the clasp towards the engaged position upon positioning the lever towards the locked position.

25. The skate of claim 20, and further comprising a plurality of spaced-apart slots for receiving the clasp, each slot selectively positioned to define the length of the boot when the latching mechanism locks the heel portion to the chassis.

26. The skate of claim 25, wherein the plurality of slots are disposed within the chassis.

* * * * *

UNITED STATES PATENT AND TRADEMARK OFFICE

CERTIFICATE OF CORRECTION

PATENT NO. : 6,916,027 B2
APPLICATION NO. : 10/325604
DATED : July 12, 2005
INVENTOR(S) : Chen It is certified that error appears in the above-identified patent and that said Letters Patent is hereby corrected as shown below:

Column 6,

Claim 15, line 30: "chassis" should be --frame--.

Claim 15, line 32: "chassis" should be --frame--.

Column 7,

Claim 18, line 6: "chassis" should be --frame--.

Claim 18, line 8: "chassis" should be --frame--.

Column 8

Claim 20, line 1: "thechassis" should be --the chassis--

Signed and Sealed this

Nineteenth Day of September, 2006

JON W. DUDAS
*Director of the United States Patent and Trademark Office*